US008683789B2

(12) United States Patent
Willats et al.

(10) Patent No.: US 8,683,789 B2
(45) Date of Patent: Apr. 1, 2014

(54) EXHAUST VALVE ASSEMBLY WITH INTERMEDIATE POSITION

(75) Inventors: Robin Willats, Columbus, IN (US); Joseph Callahan, Greenwood, IN (US); Kwin Abram, Columbus, IN (US)

(73) Assignee: Faurecia Emissions Control Technologies, Columbus, IN (US)

( * ) Notice: Subject to any disclaimer, the term of this patent is extended or adjusted under 35 U.S.C. 154(b) by 2170 days.

(21) Appl. No.: 11/602,675

(22) Filed: Nov. 21, 2006

(65) Prior Publication Data

US 2008/0115748 A1 May 22, 2008

(51) Int. Cl.
*F01N 1/00* (2006.01)

(52) U.S. Cl.
USPC ..... 60/324; 60/285; 60/292; 123/90.15; 123/90.18

(58) Field of Classification Search
USPC ..... 60/324, 285, 292, 322; 123/90.15, 123/90.16, 90.17, 90.18
See application file for complete search history.

(56) References Cited

U.S. PATENT DOCUMENTS

| | | | | |
|---|---|---|---|---|
| 4,707,987 | A * | 11/1987 | Atkin | 60/324 |
| 4,875,336 | A * | 10/1989 | Hayashi et al. | 60/286 |
| 7,536,990 | B2 * | 5/2009 | Willats et al. | 123/323 |
| 2005/0109024 | A1 * | 5/2005 | Nohl et al. | 60/324 |
| 2005/0257517 | A1 * | 11/2005 | Lavin | 60/288 |

* cited by examiner

*Primary Examiner* — Binh Q Tran
(74) *Attorney, Agent, or Firm* — Pamela A. Kachur

(57) ABSTRACT

An exhaust valve assembly includes a flapper valve that is mounted on a shaft for rotation within an exhaust component housing between a closed position, an intermediate position, and an open position. An electric actuator is coupled to the shaft to control movement of the flapper valve. The electric actuator moves the flapper valve to the open position for high speed engine conditions. When engine speeds are lowered, and while all engine cylinders remain active, the electric actuator moves the flapper valve to the intermediate position. Once the flapper valve is in the intermediate position, if an engine cylinder is subsequently deactivated, the electric actuator quickly and quietly moves the flapper valve from the intermediate position to the closed position.

18 Claims, 2 Drawing Sheets

| | | ENGINE OPERATING MODE | |
|---|---|---|---|
| | | CYLINDER DEACTIVATION MODE | 'NORMAL' MODE ALL CYLINDERS ACTIVE |
| ENGINE SPEED OR LOAD RANGE | LOW–MID | VALVE CLOSED | VALVE PART OPEN |
| | MID–HIGH | NOT APPLICABLE | VALVE FULL OPEN |

FIG.5

EXHAUST VALVE ASSEMBLY WITH INTERMEDIATE POSITION

TECHNICAL FIELD

The subject invention relates to a control for an exhaust valve assembly that allows an exhaust valve to be rapidly and quietly closed as needed for vehicles including cylinder deactivation technology.

BACKGROUND OF THE INVENTION

Some vehicle engines utilize cylinder deactivation technology, which deactivates one or more engine cylinders at lower engine speeds to provide desired engine performance characteristics. Exhaust valve assemblies have been used in vehicle exhaust systems to attenuate exhaust noise in exhaust systems using cylinder deactivation technology.

Current designs utilize a flapper valve that operates in two positions, i.e. an open position and a closed position. The flapper valve is in the open position when all engine cylinders are active, and is in the closed position when one or more cylinders are deactivated. This type of flapper valve rotates through a range of sixty to ninety degrees to move from the open position to the closed position.

With such technology, valve actuation is required to be fast to rapidly attenuate low frequency noise when an engine switches to a cylinder deactivation mode. However, valve actuation is also required to be quiet to avoid generating audible noise resulting from opening and closing events of the flapper valve within the exhaust system. These two requirements are often in conflict with each other, and can increase overall cost of the valve assembly as a result of providing additional features within the exhaust valve assembly to address these issues. For example, controls can be added to control or shape a current supplied to an electric actuator in an attempt to provide rapid, yet quiet, open and close events, or compliant stops can be incorporated into the exhaust system to reduce noise.

Thus, there is a need for an improved control for an exhaust valve assembly that provides rapid and quiet actuation and overcomes the difficulties discussed above.

SUMMARY OF THE INVENTION

A method for controlling an exhaust valve assembly includes supporting a flapper valve for rotation between an open position, an intermediate position, and a closed position. The flapper valve is moved to the open position for higher engine speed conditions, and is moved to the intermediate position for lower engine speed conditions while all engine cylinders remain active. The flapper valve is subsequently moved from the intermediate position to the closed position in response to a cylinder deactivation signal.

In one example, the flapper valve is fixed to a shaft that is mounted for rotation within, and relative to, an exhaust component housing. An electric actuator is coupled to the shaft and actively moves the flapper valve between the discrete identified valve positions. The flapper valve rotates about an axis of rotation defined by the shaft. The flapper valve rotates from the closed position, where the flapper valve is orientated generally perpendicular to an axis defined by a direction of exhaust flow, to the open position where the flapper valve is orientated generally parallel to, or at a slight angle relative to, the axis defined by the direction of exhaust flow. The flapper valve is also moveable to the intermediate position, in which the flapper valve is orientated at a position within a range of approximately 30-60 degrees relative to the axis defined by the direction of exhaust flow. In one disclosed example, the intermediate position is at 45 degrees.

By allowing the flapper valve to be positioned at an intermediate position for lower engine speeds during full cylinder activation, rapid closing events occur only between the intermediate position and the closed position for cylinder deactivation. This satisfies actuation speed and time requirements and reduces angular velocity, which result in reduced noise. Additionally, electric actuator speed requirements are reduced which provides a cost reduction for the electric actuator, and additional noise attenuation features are no longer required.

These and other features of the present invention can be best understood from the following specification and drawings, the following of which is a brief description.

BRIEF DESCRIPTION OF THE DRAWINGS

FIG. 5 is a chart identifying relationships between engine speed, cylinder mode, and valve position.

DETAILED DESCRIPTION OF THE PREFERRED EMBODIMENT

Figure 1:
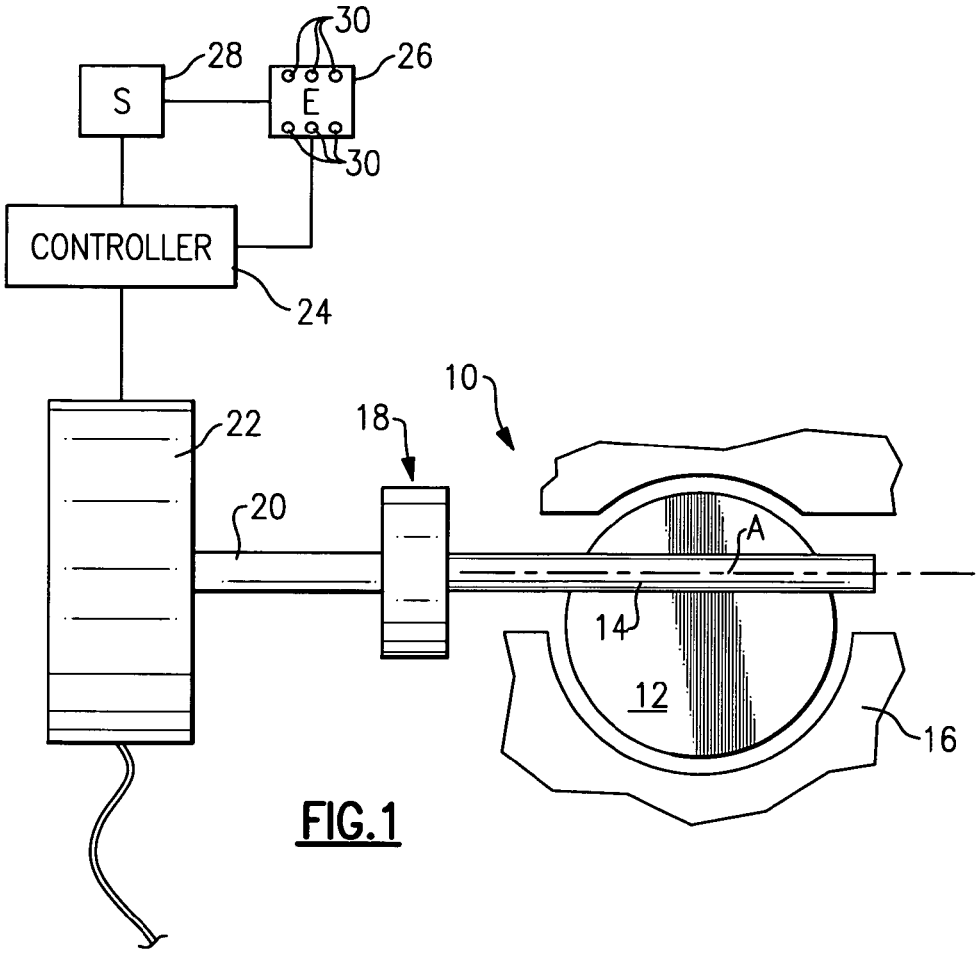
FIG. 1 is a schematic view of an exhaust valve assembly and control system incorporating the subject invention.

An exhaust valve assembly is shown generally at 10 in FIG. 1. The exhaust valve assembly 10 includes a flapper valve 12 that is fixed for rotation with a valve shaft 14. The valve shaft 14 is supported for rotation within, and relative to, an exhaust component housing 16 as known. The valve shaft 14 defines an axis of rotation A. A coupling mechanism 18 couples the valve shaft 14 to an actuator shaft 20 that is driven by an electric actuator 22. Any type of coupling mechanism can be used, or optionally, the actuator shaft and valve shaft 14 could be formed as a common shaft. The electric actuator 22 drives the flapper valve 12 between a closed position, an intermediate position, and an open position. The electric actuator 22 holds the flapper valve 12 in these discrete positions under certain predefined conditions. This will be discussed in greater detail below.

A controller 24 sends control signals to the electric actuator 22 to control movement of the flapper valve 12 according to desired specifications. The controller 24 receives information from an engine 26 via sensors 28 or from a controller associated with the engine 26. The controller 24 could be a common controller for the engine 26 and electric actuator 22, or separate controllers could be used.

The engine 26 includes a plurality of cylinders 30 as known. The sensors 28 can be used to monitor and measure engine speed and/or can be used to identify when engine cylinders have been activated or deactivated, for example. The controller 24 receives this data and determines when the engine 26 is operating with one or more deactivated cylinders. The controller 24 generates a control signal that is communicated to the electric actuator 22 to control movement of the flapper valve 12 in response to cylinder deactivation, varying engine speed, etc. to provide desired performance and sound characteristics.

Figure 2:
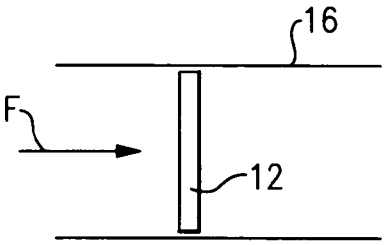
FIG. 2 is a schematic representation of the exhaust valve assembly of FIG. 1 in a closed position.
Figure 3:
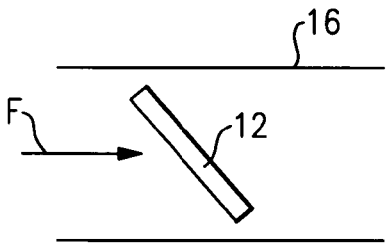
FIG. 3 is a schematic representation of the exhaust valve assembly of FIG. 1 in an intermediate position.
Figure 4:
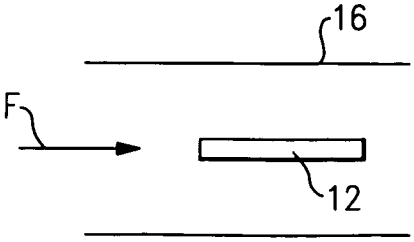
FIG. 4 is a schematic representation of the exhaust valve assembly of FIG. 1 in an open position.

FIG. 2 shows the flapper valve 12 positioned within the exhaust component housing 16 in the closed position. An axis defined by a direction of exhaust flow is identified as "F." FIG. 3 shows the flapper valve 12 in the intermediate position and FIG. 4 shows the flapper valve 12 in the open position. Generally, the flapper valve 12 is perpendicular to, or at a slight angle relative to, the axis F when in the closed position; is at a position within a range of approximately 30-60 degrees relative to the axis F when in the intermediate position; and is parallel to, or at a slight angle relative to, the axis F when in the open position. In one disclosed embodiment, the intermediate position is at 45 degrees.

As exemplified in FIG. 5, during high engine speed conditions, such as when the engine 26 is operating under full power for example, the electric actuator 22 moves the flapper valve 12 to, and holds the flapper valve 12 in, the open position (FIG. 4). When operating under these conditions, all engine cylinders 30 are active. When lower engine speeds are sensed, the electric actuator 22 moves the flapper valve 12 to, and holds the flapper valve 12 in, the intermediate position (FIG. 3). In this position all cylinders 30 remain active, however, the flapper valve 12 is ready for rapid closure if necessary. Once one or more of the cylinders 30 is deactivated, the electric actuator 22 rapidly moves the flapper valve 12 from the intermediate position to the closed position (FIG. 2).

It should be understood that determination of differences between high engine speed conditions and low engine speed conditions will vary depending on various factors such as engine type, vehicle application, etc.

By using this intermediate position, rapid closing events only occur between the intermediate position and the closed position. This satisfies actuation speed and time requirements and reduces angular velocity, which result in reduced noise. Additionally, electric actuator speed requirements are reduced which provides a cost reduction, and additional noise attenuation features are potentially no longer required.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method for controlling an exhaust valve assembly comprising:

(a) providing a flapper valve supported on a valve shaft for rotation within an exhaust component housing between an open position, an intermediate position, and a closed position;

(b) moving the flapper valve to the intermediate position for a low engine speed condition; and (c) moving the flapper valve from the intermediate position to the closed position in response to a cylinder deactivation signal.

2. The method according to claim 1 including moving the flapper valve to the open position at a high engine speed condition.

3. The method according to claim 1 including defining the intermediate position as the flapper valve being orientated approximately within a range of 30-60 degrees relative to an axis defined by a direction of exhaust flow.

4. The method according to claim 1 wherein step (b) includes moving the flapper valve to the intermediate position for the low engine speed condition and when all engine cylinders are active.

5. The method according to claim 4 wherein step (c) includes sensing engine speed, sensing cylinder deactivation to generate the cylinder deactivation signal, transmitting engine speed data and the cylinder deactivation signal to a controller, and generating a control signal for communication to an electric actuator to rapidly move the flapper valve from the intermediate position to the closed position.

6. The method according to claim 1 including sensing a high speed engine condition subsequent to step (c) and moving the flapper valve from the closed position to the open position.

7. An exhaust valve assembly comprising:

a flapper valve mounted on a shaft for rotation within an exhaust component housing, said flapper valve being moveable between a closed position, an intermediate position, and an open position;

an actuator coupled to said shaft to actively move the flapper valve between the closed, intermediate, and open positions; and a controller that determines when one or more engine cylinders have been deactivated, and which controls activation of said actuator, wherein said controller generates a control signal for said actuator to move said flapper valve from said intermediate position to said closed position in response to a determination that at least one engine cylinder has been deactivated.

8. The exhaust valve assembly according to claim 7 wherein said intermediate position is defined as said flapper valve being orientated approximately within a range of 30-60 degrees relative to an axis defined by a direction of exhaust flow within the exhaust component housing.

9. The exhaust valve assembly according to claim 8 wherein said open position is generally parallel to said axis and said closed position is generally perpendicular to said axis.

10. The exhaust valve assembly according to claim 7 wherein said controller activates said actuator to move said flapper valve into said open position during high speed engine conditions.

11. The exhaust valve assembly according to claim 10 including at least a first sensor for sensing engine speed and generating an engine speed signal that is transmitted to said controller, and a second sensor for sensing engine cylinder deactivation and generating a cylinder deactivation signal that is transmitted to said controller.

12. The exhaust valve assembly according to claim 11 wherein said controller holds said flapper valve in said open position during higher speed engine conditions, holds said flapper valve in said intermediate position during lower speed engine conditions and when all engine cylinders are active, and rapidly returns said flapper valve to said closed position from said intermediate position when at least one engine cylinder is deactivated.

13. The exhaust valve assembly according to claim 7 wherein said actuator holds said flapper valve in said intermediate position in response to a control signal generated by a controller that indicates lower speed engine conditions in combination with all engine cylinders being active.

14. The exhaust valve assembly according to claim 13 wherein said controller holds said flapper valve in said open position during higher speed engine conditions and rapidly returns said flapper valve to said closed position from said intermediate position in response to said control signal indicating that at least one engine cylinder is deactivated.

15. The method according to claim 1 including actively moving the flapper valve between the open, closed, and intermediate positions with an actuator that receives control signals from a controller.

16. The method according to claim 15 including holding the flapper valve in the open position when the actuator receives a control signal indicating higher speed engine conditions, holding the flapper valve in the intermediate position when the actuator receives a control signal indicating lower speed engine conditions in combination with all engine cylinders being active, and rapidly returning the flapper valve to the closed position from the intermediate position when the actuator receives a control signal indicating that at least one engine cylinder is deactivated.

17. The method according to claim 1 wherein step (c) further includes rapidly moving the flapper valve to the closed position in response to the cylinder deactivation signal to attenuate low frequency noise.

18. The exhaust valve assembly according to claim 7 wherein said controller rapidly moves said flapper valve to said closed position in response to deactivation of at least one engine cylinder to attenuate low frequency noise.

* * * * *